US006126213A

United States Patent [19]

Jones et al.

[11] Patent Number: 6,126,213

[45] Date of Patent: Oct. 3, 2000

[54] CONTAINER CLAMPING RING WITH IMPROVED LEVER AND THUMB LATCH

[75] Inventors: Mike Jones, Grand Bay; Rodger Glass, Mobile; George Gray, Mobile; William Berry, Mobile, all of Ala.

[73] Assignee: Greif Bros. Corp. of Ohio, Inc., Delaware, Ohio

[21] Appl. No.: 09/438,257

[22] Filed: Nov. 10, 1999

Related U.S. Application Data

[63] Continuation of application No. 08/663,860, Jun. 19, 1996, which is a continuation of application No. 08/533,384, Sep. 25, 1995, abandoned, which is a continuation of application No. 08/185,453, Jan. 24, 1994, abandoned.

[51] Int. Cl.[7] ..... B65D 45/30; B65D 45/32

[52] U.S. Cl. ..... 292/256.6; 292/307 R; 292/DIG. 49

[58] Field of Search ..... 292/256.69, 113, 292/247–250, 307 R, DIG. 49

[56] References Cited

U.S. PATENT DOCUMENTS

| | | | |
|---|---|---|---|
| 2,265,167 | 12/1941 | Huthersall | 292/256.69 |
| 2,579,975 | 12/1951 | Scott et al. | 292/256.69 |
| 2,864,638 | 12/1958 | Nelson et al. | 292/256.69 |
| 2,966,378 | 12/1960 | Carpenter et al. | 292/256.69 |
| 3,070,397 | 12/1962 | Rodish | 292/256.69 |
| 3,261,632 | 7/1966 | Schaefer | 292/256.69 |
| 3,339,961 | 9/1967 | Schaefer | 292/256.69 |
| 3,439,949 | 4/1969 | Bobula et al. | 292/256.69 |
| 3,708,835 | 1/1973 | Bienz | 292/307 R |
| 3,768,848 | 10/1973 | Santoni | 292/256.69 |
| 3,837,101 | 9/1974 | Young | 292/307 R |
| 3,955,842 | 5/1976 | Edwards | 292/307 R |
| 4,106,801 | 8/1978 | DeLima Castro Neto | 292/307 R |
| 4,532,679 | 8/1985 | Scott | 292/307 R |
| 5,085,476 | 2/1992 | Fuehrer | 292/307 R |

FOREIGN PATENT DOCUMENTS

| | | | |
|---|---|---|---|
| 2602888 | 7/1977 | Germany | 292/256.69 |
| 654143 | 5/1963 | Italy | 292/307 R |
| 549621 | 8/1942 | United Kingdom | 292/256.69 |

*Primary Examiner*—Lynne H. Browne
*Assistant Examiner*—John B. Walsh
*Attorney, Agent, or Firm*—Vorys, Sater, Seymour and Pease LLP

[57] ABSTRACT

A lever and latch assembly for a split ring for securing a cover on a drum includes a bar on the lever for disposition in a pocket of latch with a snap action. An enlarged finger engaging flange on the latch facilitates movement to a latched position and an unlatched position with a suitable tool. The assembly is designed to accommodate domestic and international seals for security purposes.

12 Claims, 6 Drawing Sheets

CONTAINER CLAMPING RING WITH IMPROVED LEVER AND THUMB LATCH

CROSS REFERENCE TO RELATED APPLICATIONS

This application is a continuation of application Ser. No. 08/663,860 filed Jun. 19, 1996 which is a continuation of application Ser. No. 08/533,384 filed Sep. 25, 1995 now abandoned, which is a continuation of application Ser. No. 08/185,453 filed Jan. 24, 1994 now abandoned.

BACKGROUND OF THE INVENTION

The drum top clamping ring of this invention constitutes an improvement over the type commercially available and marketed and particularly the version of clamping ring disclosed in U.S. Pat. No. 3,768,848, granted Oct. 30, 1973. The clamping rings disclosed in this patent generally include horizontal levers which are pivotal in a plane parallel to the plane of the ring as well as the top rim of the drum. The levers are normally held in a closed clamped position by a vertically pivotal latch.

SUMMARY OF THE INVENTION

The principal object of the present invention is to provide an improved lever and latch assembly of the foregoing type for drum top clamping rings that features interengaging camming and latching surfaces that cooperate in retaining the lever in the latched position and clamping ring in its clamped position.

Another object is to provide a lever and latch assembly of the foregoing type in which a confinement pocket and extrusion cooperate in providing a snap action when the latch is forced into its latched position.

A further object is to provide the confinement pocket in the shape of a long, horizontal pocket thereof providing sliding movement for the lever-tab bar incident to the ring stretching when installing the ring on the container top rim.

Still another object is to provide a lever and latch assembly of the foregoing type in which the latch includes a radial inwardly projecting substantially horizontal thumb-tab that serves to prevent the latch from pivoting beyond its horizontal latched position and at the same time providing increased surface area for manually forcing the latch into its latched position and for receiving a screwdriver or similar tool to facilitate pivoting the latch to its unlatched position at which the lever may be swung outwardly to move the clamping ring to its unclamped position.

A still further object is to provide a lever and latch assembly that is capable of accepting many of the domestic and international seals to accommodate the security needs of a wide variety of customers.

Other objects and advantages will become apparent from the following description which is to be taken in conjunction with the accompanying drawings.

DETAILED DESCRIPTION OF THE PREFERRED EMBODIMENTS

Figure 1:
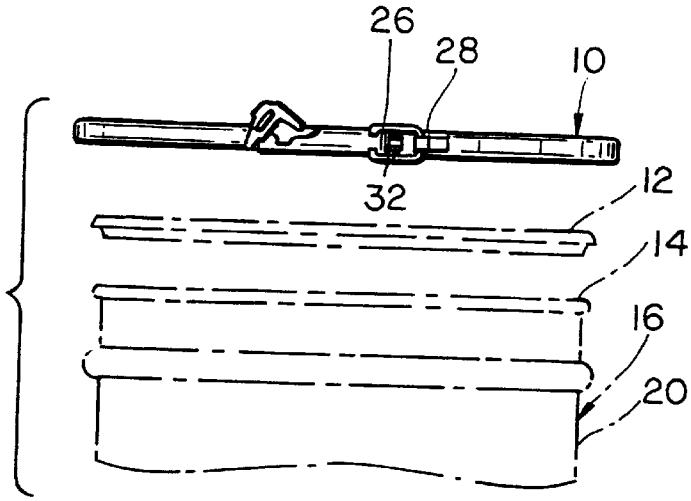
FIG. 1 is an exploded elevational view of the clamping ring of the present invention shown in its clamped position with a cover in phantom and a drum also in phantom and shown fragmentarily.
Figure 2:
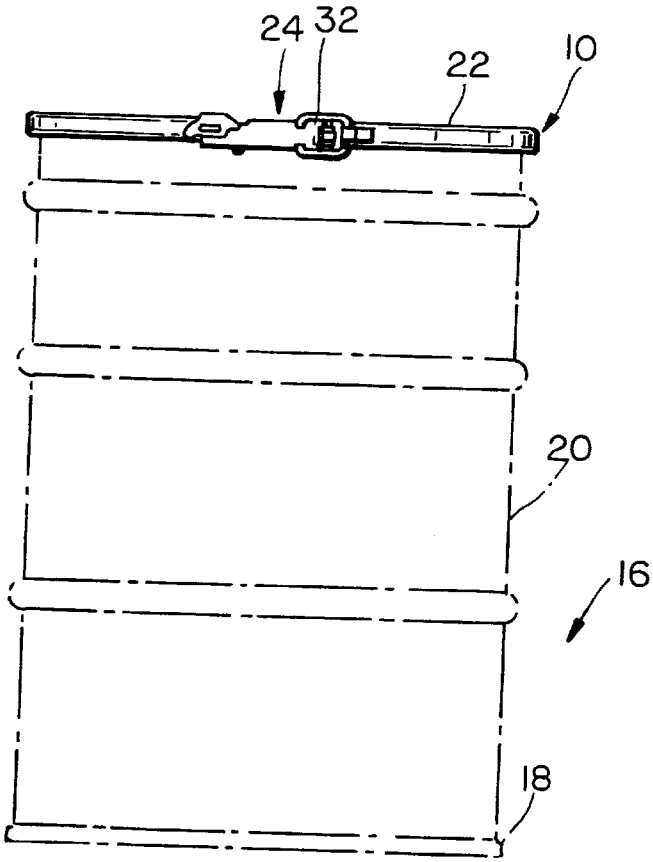
FIG. 2 is an elevational view of the clamping ring securing the cover on the drum top rim shown in phantom.
Figure 3:
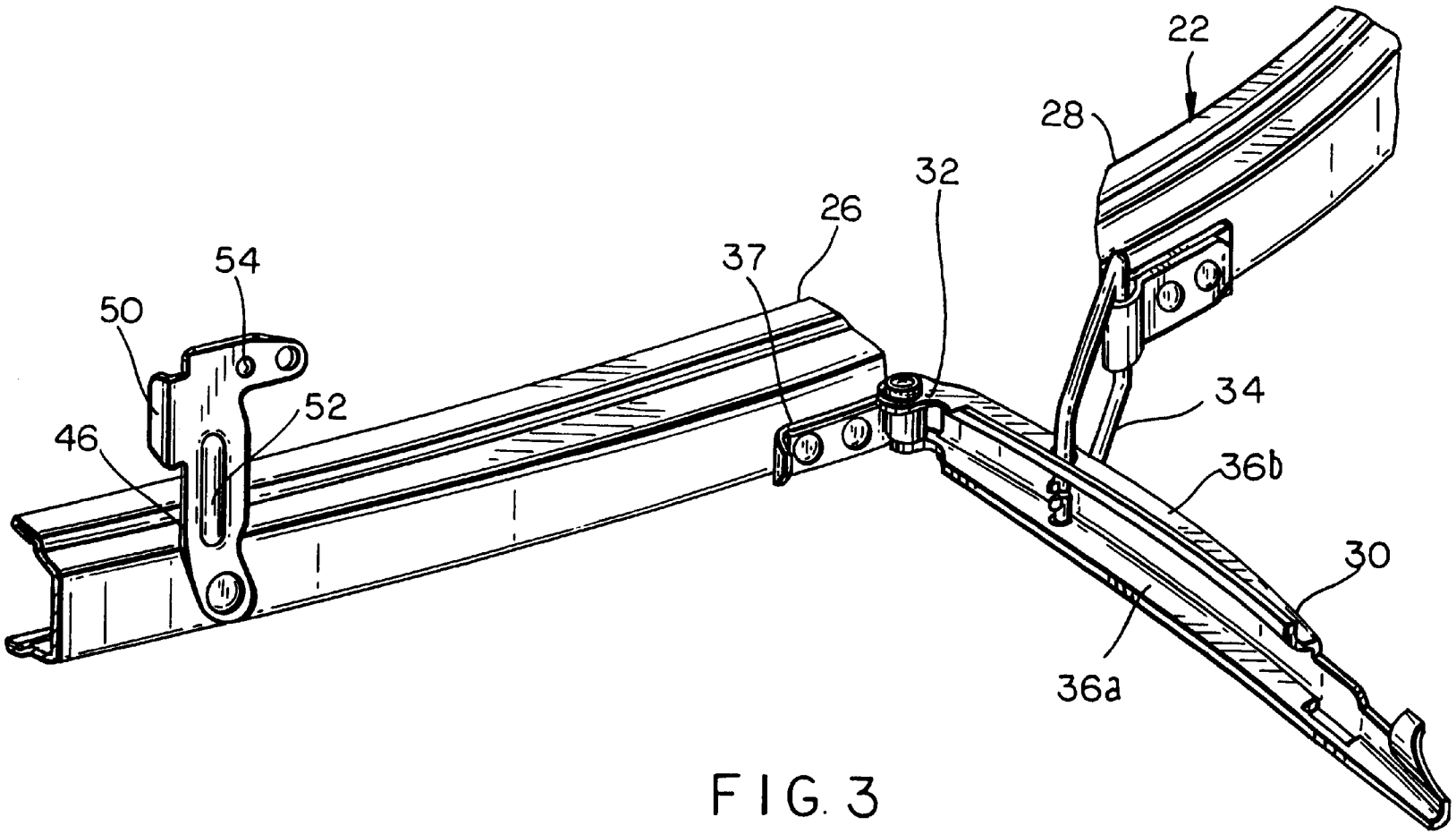
FIG. 3 is an enlarged fragmentary perspective view of the lever and latch in a fully unlatched position with the split ring in its expanded condition.
Figure 6:
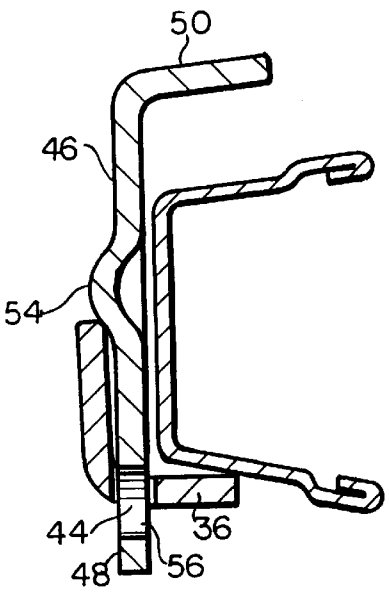
FIG. 6 is a cross sectional view taken along the line 6—6 of FIG. 4.
Figure 4:
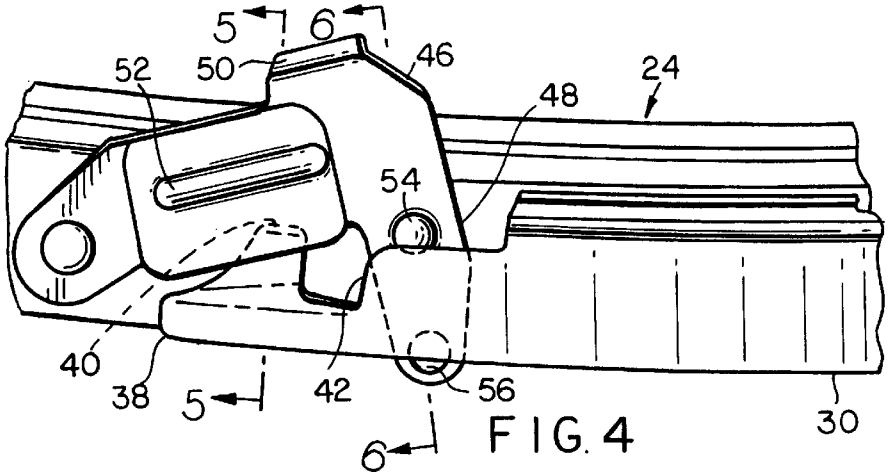
FIG. 4 is an enlarged fragmentary elevational view showing the split ring in its clamped position and of the lever and latch at the beginning of the pivotal movement of the latch to the latched position.

In the form of the invention illustrated in FIGS. 1–9, the improved clamping ring 10 serves to releasably close the cover 12 across the top rim 14 defining the top opening of the drum or container 16 which may be constructed of fiber, plastic or metal in a manner well known to the art. A typical drum 16 will include a bottom closure 18 secured to the lower peripheral edge of the tubular body 20.

The improved clamping ring 10 includes split ring 22 made of suitable resilient metal such as steel and is provided with a lever and latch assembly 24 connected between ends 26 and 28 in a manner well understood in the art that permits the ring 22 to be expanded to permit its placement around the cover 12 and drum top rim 14 and constructed and clamped to lightly engage the assembled cover 12 on the drum 16.

In the lever and latch assembly 24 illustrated in the drawings, a locking lever 30 is suitably pivoted or hinged at its base end 32 to ring end 26 in a conventional manner. The locking lever 30 is also pivotally connected at an intermediate point to link 34 which is pivotally connected to ring end 28. Inwardly extending flange **36*a* and 36*b* engage the bottom and top, respectively, of the split ring 22 when the lever is pivoted inwardly. Thus, when the lever 30 is pivoted outwardly relative to the split ring 22, the ring is expanded to permit its assembly about the combined cover 12 and drum 16; and when the lever is pivoted inwardly and eventually into engagement with the split ring 22**, the ring is contracted to exert a compressive and then holding force about the assembled cover and drum.

In order to assure the proper relationship of the lever 30 and the split ring 22, as the lever is being pivoted to its locking position, a hinge strap 37 is provided with outwardly extending guide surfaces that advantageously nest or are disposed between the flanges **36*a* and 36*b*. When this relationship occurs, the locking lever 30** is in its proper closed position and any upwardly or downwardly directed force or pressure on the locking lever will cause its flanges to engage with these guide surfaces.

The free end of the lever 30 is formed with a tab 38 having an inwardly projecting enlongated bar 40 having an outwardly projecting bar free end slot 42 and opening 44 for receiving surfaces of the latch.

Figure 5:
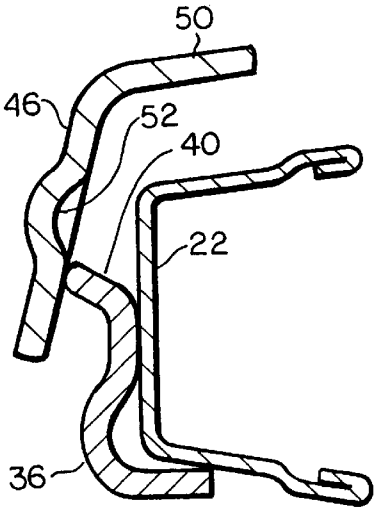
FIG. 5 is a cross sectional view taken along the line 5—5 of FIG. 4.
Figure 7:
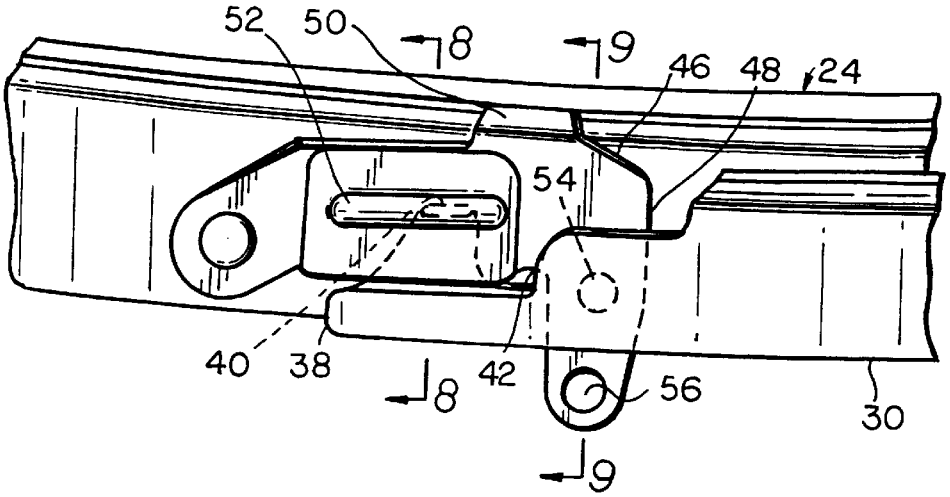
FIG. 7 is an enlarged fragmentary elevational view of the lever and latch in their latched position.
Figure 8:
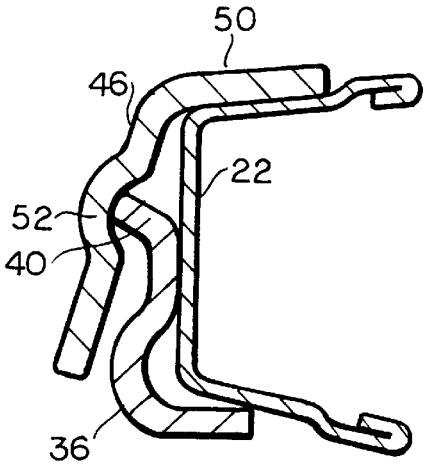
FIG. 8 is a cross sectional view taken along the line 8—8 of FIG. 7.
Figure 9:
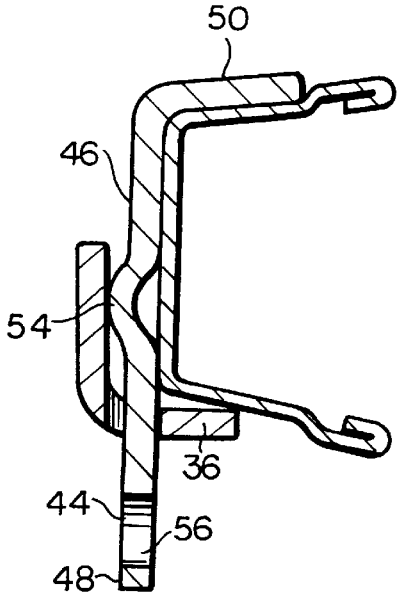
FIG. 9 is a cross sectional view taken along the line 9—9 of FIG. 7.

The latch 46 is vertically shiftable and advantageously releasably locks or latches the free end of the lever in the clamped position. In this regard, the latch 46 is pivotally mounted on the split ring 22 between an upwardly extending unlocked or unlatched position to a horizontally locking or latched position. Towards this end, the latch 46 is formed with locking finger 48 which will extend into opening 44 and engage the tab 38 of the lever 30 to retain the latter in its inward locked position. An enlarged inwardly extending thumb tab 50 is adapted to conveniently receive a thumb to pivot the latch to its downward locked position at which it will engage with surfaces of the split ring 22 to assure that the latch will not pivot beyond this horizontal position. The latch 46 further maintains lever 30 in a locked position by receiving the free end of bar 40 in an elongated pocket 52. The pocket is much longer than it is wide. This bar 40 will operate to cam the latch outwardly as the latch is pivoted downwardly as shown in FIG. 5 and the bar free end will be received in the pocket 52 as shown in FIG. 8 with a snap action. As shown in FIG. 8, the free end of bar 40 will be in engagement with internal surface of the pocket 52. Sliding movement is thereby permitted between the free end of bar 40 and pocket 52 as the split ring is stretched about the cover to the clamped position. In order to maintain the free end of bar 40 in pocket 52 and the latch 46 in its horizontal position at which the lever 30 is locked, an outwardly projecting dimple 54 engages surfaces of the tab 38 to urge lever 30 outwardly as shown in FIG. 9 so that the free end of bar 40 is urged further into engagement with the internal surface of the pocket 52. The free end of the finger 48 may be formed with a hole 56 for receiving the wire of conventional sealing means which operates to reveal premature opening of the clamping ring 10.

When the cover 12 is initially applied to the open top rim 14 of the drum 16, the clamping ring 10 is assembled around the cover 12 and rim 14 while the locking lever 30 is in its outwardly extending open position. Thereafter, the lever 30 is pivoted inwardly toward the split ring 22 to contact the ring with flange 36*a* and 36*b* engaging and disposed around the ring 22. The latch 46 is then pivoted downwardly by applying digital pressure to the top of thumb-tab 50 until the finger 48 extends through hole 44 and the free end of tab bar 40 snaps into the pocket 52. This position is releasably maintained by the interengagement of the dimple 54 with the inner face of the lever tab 38 which urges the free end of the bar 40 further into engagement with the internal surface of the pocket 52. In order to release the latch 46 from the lever 30, a tool such as a screwdriver is forced under tab 50 to pry the latch upwardly to free the bar 40 from pocket 52. The split ring 22 may then be removed and the cover 12 removed to obtain access to the contents of the drum 16.

As explained the lever and latch assembly 24 is capable of accepting many of the domestic and international seals in use today to accommodate the security needs of customers.

Figure 10:
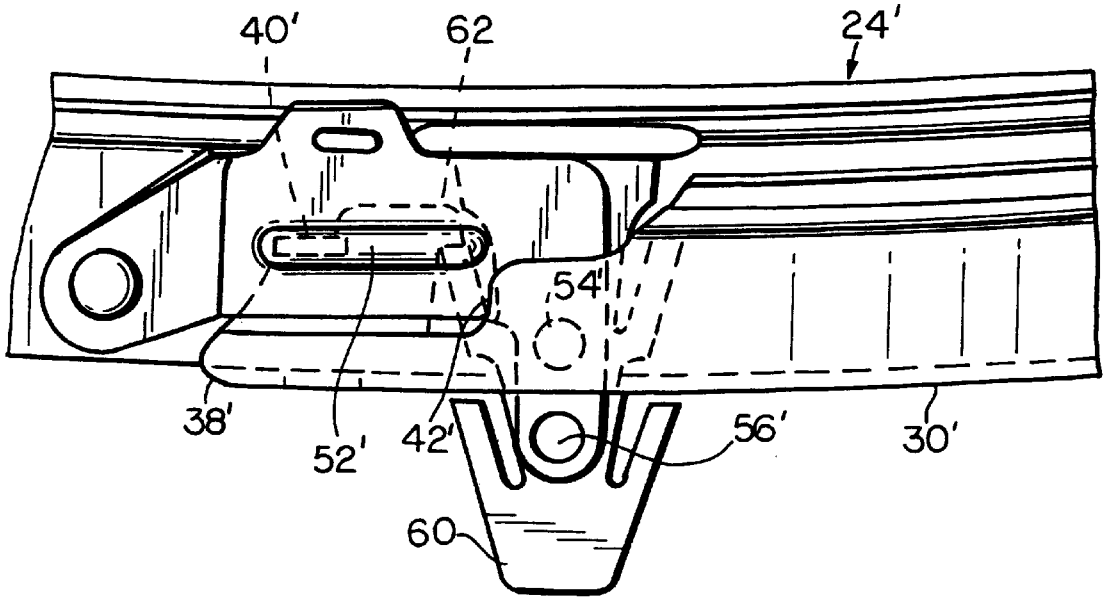
FIG. 10 is a fragmentary elevational view of another embodiment of the lever and latch assembly designed to receive the Euro-style seal.
Figure 11:
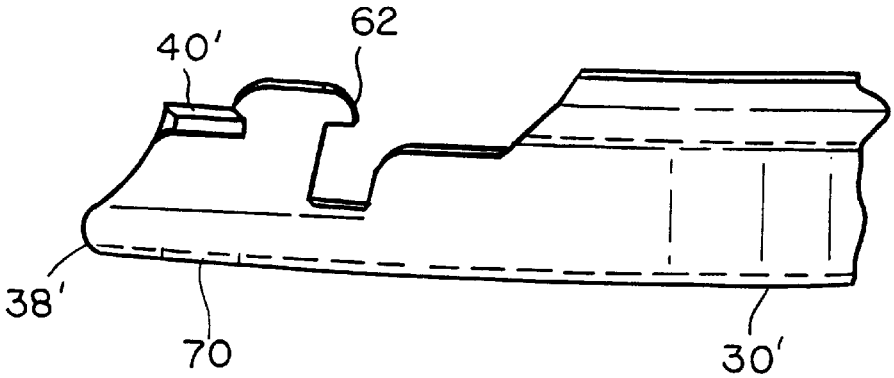
FIG. 11 is an enlarged fragmentary elevational view of the modified lever of the assembly of FIG. 10.

In FIG. 10 the "euro-style" seal 60 is received and for this purpose the tab 38' is provided with projection 62 (see FIG. 11). Like parts are denoted with like numerals with an accompanying prime.

Figure 12:
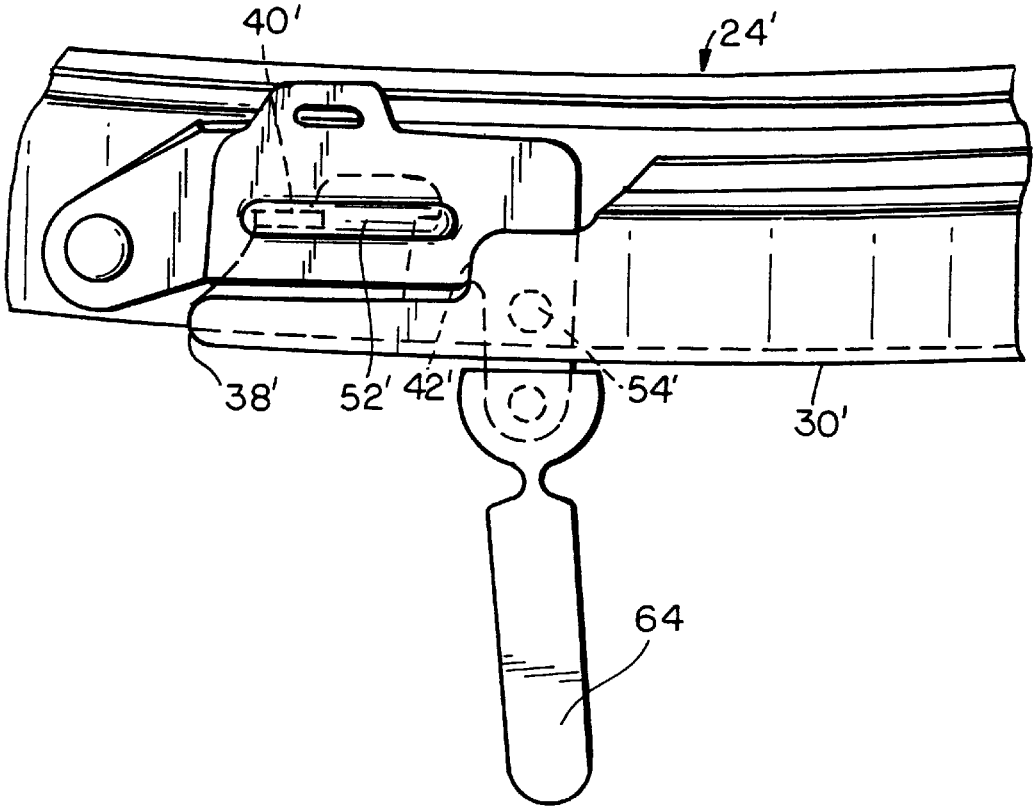
FIG. 12 is a fragmentary elevational view of the lever and latch assembly of FIG. 10 accepting a Stoffil seal.

The stoffel seal 64 is conveniently received as shown in FIG. 12. otherwise, the parts are the same as in FIG. 10.

Figure 13:
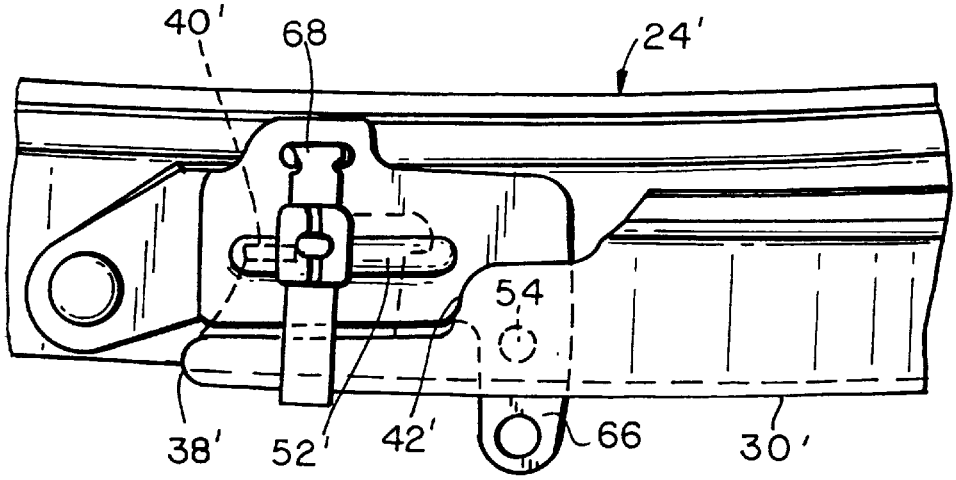
FIG. 13 is an enlarged fragmentary elevational view of the lever and latch assembly accepting a "Seal-tite" band seal.

To incorporate the "Seal-tite" band seal, 66 of FIG. 13, a slot 68 is formed in the latch 46' and also a matching slot 70 in the bottom edge of the lever 30' vertically in line with the latch slot 68 when the latch and lever are closed.

Thus, the several aforementioned objects and advantages are most effectively attained. Although several somewhat preferred embodiments have been disclosed and described in detail herein, it should be understood that this invention is in no sense limited thereby and its scope is to be determined by that of the appended claims.

What is claimed is:

1. A clamping ring for use in releasably holding a cover in assembled relationship with a drum, comprising:

a split ring having two ends positioned substantially adjacent to one another;

a lever having an intermediate portion, a base pivotally connected with one of the ends of the split ring, and a free end having a tab with an upwardly and outwardly projecting bar that has an outwardly projecting bar free end;

a linkage pivotally connecting the other end of the split ring with the intermediate portion of the lever;

the lever and the lever linkage being constructed and arranged so that the lever is shiftable from an open position away from the split ring, at which the split ring is in an expanded state, to a locking position adjacent to the split ring, at which the split ring is in a contracted state;

a latch pivotally connected with the split ring and adapted to be shifted downwardly from an elevated unlatched position away from the split ring to a lowered latched position adjacent to the split ring and at which the latch engages the lever while the lever is in the its locking position, the latch having an elongated internal confinement pocket for receiving the bar free end, the pocket extending outwardly, having a width, and having a length much longer than the width;

the length of the pocket extending in a horizontal direction, substantially circumferentially of the split ring, when the latch is in the lowered latched position;

the lever and latch having interengaging surfaces such that the bar will engage inner surfaces of the latch and will cam the latch outwardly when the latch is shifted downwardly to the latched position and so that the bar free end will be received in the pocket with a snap action an into engagement with internal surfaces of the pocket, the bar free end having a dimension along the length of the pocket that is substantially less than the length of the pocket so as to permit sliding movement of the bar free end along the length of the pocket;

the interengaging surfaces also including an outwardly projecting dimple on the latch for urging the lever outwardly so that the bar free end is urged further into engagement with the internal surfaces of the pocket for cooperating in maintaining the bar in the pocket;

the latch being provided with a finger-engaging tab flange for facilitating the shifting of the latch to the latched position and the shifting out of the latched position.

2. A clamping ring in accordance with claim 1, wherein the pivotal connections of the lever and the linkage are disposed at right angles to the plane of the split ring so that the lever is shiftable in substantially the same plane as the split ring, and the pivotal connection of the latch is disposed at a right angle to the split ring so that the latch is shiftable in a plane substantially normal to the plane of the split ring and the latched position of the latch is substantially in the plane of the split ring.

3. A clamping ring in accordance with claim 1, wherein the latch has a depending finger which engages with surfaces of the lever to retain the lever in the locking position and is adapted to be shifted away from the plane of the split ring to disengage from the lever, thereby enabling the lever the be pivoted to the open position.

4. A clamping ring in accordance with claim 3, wherein the lever has an opening for receiving the finger of the latch.

5. A clamping ring in accordance with claim 1, wherein the latch and the lever are so constructed and arranged to receive a euro-style seal.

6. A clamping ring in accordance with claim 5, wherein the tab of the lever has a projection for cooperating in receiving the euro-style seal.

7. A clamping ring in accordance with claim 3, wherein the finger of the latch has an opening for cooperating in receiving a stoffel seal.

8. A clamping ring in accordance with claim 1, wherein the latch and the lever are so constructed and arranged to receive a seal-titer band seal.

9. A clamping ring in accordance with claim 8, wherein the lever and the latch are provided with aligned slots for receiving the band seal.

10. A clamping ring in accordance with claim 1, wherein the bar free end is elongated and said dimension of the bar free end is a length thereof.

11. A clamping ring in accordance with claim 1, wherein the finger-engaging tab cooperates in preventing the latch from pivoting downwardly beyond a horizontal position and provides increased surface area for manually forcing the latch into the latched position and for receiving a tool to facilitate pivoting the latch to the unlatched position.

12. A clamping ring in accordance with claim 11, wherein:

the pivotal connected, of lever and the linkage are disposed at right angles to the plane of the split ring so that the lever is shiftable in substantially the same plane as the split ring;

the pivotal connection of the latch is disposed at a right angle to the spit ring so that the latch is shiftable in a plane substantially normal to the plane of the split ring and the latched position of the latch is substantially in the plane of the split ring;

the latch has a depending finger which engages with surfaces of the lever to retain the lever in the locking position and is adapted to be shifted away from the plane of the split ring to disengage from the lever, thereby enabling the lever to be pivoted to the open position; and the lever has an opening for receiving the finger of the latch.

* * * * *